US012753662B2

(12) United States Patent
Siljeg et al.

(10) Patent No.: US 12,753,662 B2
(45) Date of Patent: Oct. 6, 2026

(54) RETENTION FEATURE FOR TUBULARS IN A FINGERBOARD

(71) Applicant: Nabors Drilling Technologies USA, Inc., Houston, TX (US)

(72) Inventors: David Siljeg, Conroe, TX (US); Derek Patterson, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 18/894,892

(22) Filed: Sep. 24, 2024

(65) Prior Publication Data

US 2025/0101815 A1 Mar. 27, 2025

Related U.S. Application Data

(60) Provisional application No. 63/585,361, filed on Sep. 26, 2023.

(51) Int. Cl.
*E21B 19/14* (2006.01)

(52) U.S. Cl.
CPC ..... *E21B 19/14* (2013.01)

(58) Field of Classification Search
CPC ..... E21B 19/00; E21B 19/14; E21B 19/15; E21B 19/155; E21B 19/16; E21B 19/18; E21B 19/20
See application file for complete search history.

(56) References Cited

U.S. PATENT DOCUMENTS 1,718,395 A 6/1929 Webb et al.
3,630,392 A 12/1971 Cintract
3,734,208 A 5/1973 Otto
4,421,447 A 12/1983 Gudgel et al.
6,408,954 B1 6/2002 Price et al.
6,543,551 B1 4/2003 Sparks et al.
7,018,164 B2 3/2006 Anthis et al.
(Continued)

FOREIGN PATENT DOCUMENTS

CN 212079234 U 12/2020
EP 2425091 A2 3/2012
(Continued)

OTHER PUBLICATIONS

International Search Report and Written Opinon for PCT/US2024/048186, mailed Dec. 30, 2024, 11 pages.

*Primary Examiner* — Lynn E Schwenning
(74) *Attorney, Agent, or Firm* — Christopher L. Johnson

(57) ABSTRACT

A fingerboard can include first and second fingers with a channel therebetween, and a biasing element with a first plurality of lobes that extend into the channel and define first and second locations. First and second tubulars disposed in first and second locations, where movement of the first tubular from the first location engages the first biasing element and prevents movement of the second tubular from the second location while the first tubular is engaged with the first biasing element. A fingerboard can include first and second fingers with a channel therebetween, and a biasing element with a first plurality of lobes that extend into the channel. Axially adjacent lobes define a first location therebetween, and movement of a first tubular along the channel from the first location to an adjacent second location compresses a first lobe as the first tubular moves past the first lobe.

15 Claims, 12 Drawing Sheets

(56) References Cited

U.S. PATENT DOCUMENTS

| | | | | |
|---|---|---|---|---|
| 8,747,045 | B2 | 6/2014 | Belik | |
| 2008/0053704 | A1 | 3/2008 | Zachariasen et al. | |
| 2020/0003017 | A1* | 1/2020 | Magnuson | F16L 3/227 |
| 2020/0018128 | A1* | 1/2020 | Berger | E21B 19/14 |
| 2021/0277728 | A1* | 9/2021 | Mikalsen | E21B 19/087 |
| 2022/0186571 | A1 | 6/2022 | Lien et al. | |

FOREIGN PATENT DOCUMENTS

| | | | |
|---|---|---|---|
| GB | 2175629 | A | 12/1986 |
| NO | 130057 | B | 7/1974 |
| NO | 156700 | B | 7/1987 |
| NO | 303352 | B1 | 6/1998 |
| WO | 2025072183 | A1 | 4/2025 |

* cited by examiner

LINE 3A-3A

DETAIL 3B

RETENTION FEATURE FOR TUBULARS IN A FINGERBOARD

CROSS-REFERENCE TO RELATED APPLICATION(S)

This application claims priority under 35 U.S.C. § 119 (c) to U.S. Provisional Application No. 63/585,361, entitled "RETENTION FEATURE FOR TUBULARS IN A FINGERBOARD," by David SILJEG et al., filed Sep. 26, 2023, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for retaining tubulars in a storage area during subterranean operations.

BACKGROUND

A fingerboard can include dedicated slots or rows with its primary function to support and retain tubulars at one end while racked back on the setback (drilling rig) or positioned in a storage area. Conventionally, each row or slot can accommodate a specific amount of tubulars and once they are racked back (stored) in the fingers of the fingerboard, some retention mechanism can be used to secure the pipes in the rows and restrict movement during the high winds, constant vibrations, sudden shakings, etc. Derrickman usually applies a rope around the pipes in the row to secure the tubulars in the fingerboard to prevent an inadvertent release of a tubular. However, working at the fingerboard of a vertical tubular storage area during rig operations can be dangerous. Therefore, improvements in fingerboard systems are continually needed.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

One general aspect includes a fingerboard for managing tubulars in a subterranean operation. The fingerboard also includes a plurality of fingers may include a first finger adjacent a second finger with a space therebetween that forms a channel; and a first retention feature attached to the first finger, where the first retention feature may include a first biasing element that may include a first plurality of lobes, where the first plurality of lobes extend into the channel and define a plurality of storage locations in the channel, where the plurality of storage locations may include a first storage location, a second storage location, and a third storage location; a first tubular disposed in the first storage location; and a second tubular disposed in the second storage location, where movement of the first tubular from the first storage location engages the first biasing element and prevents movement of the second tubular from the second storage location while the first tubular is engaged with the first biasing element.

One general aspect includes a fingerboard for managing tubulars in a subterranean operation. The fingerboard also includes a plurality of fingers that may include a first finger adjacent a second finger with a space therebetween that forms a channel; and a first biasing element that may include a first plurality of lobes, where the first plurality of lobes extend into the channel, where a first lobe and a second lobe are axially adjacent lobes of the first plurality of lobes, where the first lobe and the second lobe define a first storage location therebetween, and where movement of a first tubular along the channel from the first storage location to an adjacent second storage location compresses the first lobe as the first tubular moves past the first lobe.

One general aspect includes a method for managing tubulars in a fingerboard. The method also includes attaching a first retention feature to a first finger of a plurality of fingers of a fingerboard; extending a first plurality of lobes of a first biasing element from the first retention feature into a channel formed between the first finger and a second finger of the plurality of fingers, where the first finger is adjacent to the second finger; forming a first storage location between a first lobe and an adjacent second lobe of the first plurality of lobes, where the first storage location is configured to receive and retain a first tubular; forming a second storage location between the second lobe and an adjacent third lobe of the first plurality of lobes, where the second storage location is configured to receive and retain a second tubular; applying a predetermined force to the first tubular, thereby moving the first tubular out of the first storage location; and compressing the first lobe as the first tubular passes by the first lobe.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

Figure 1:
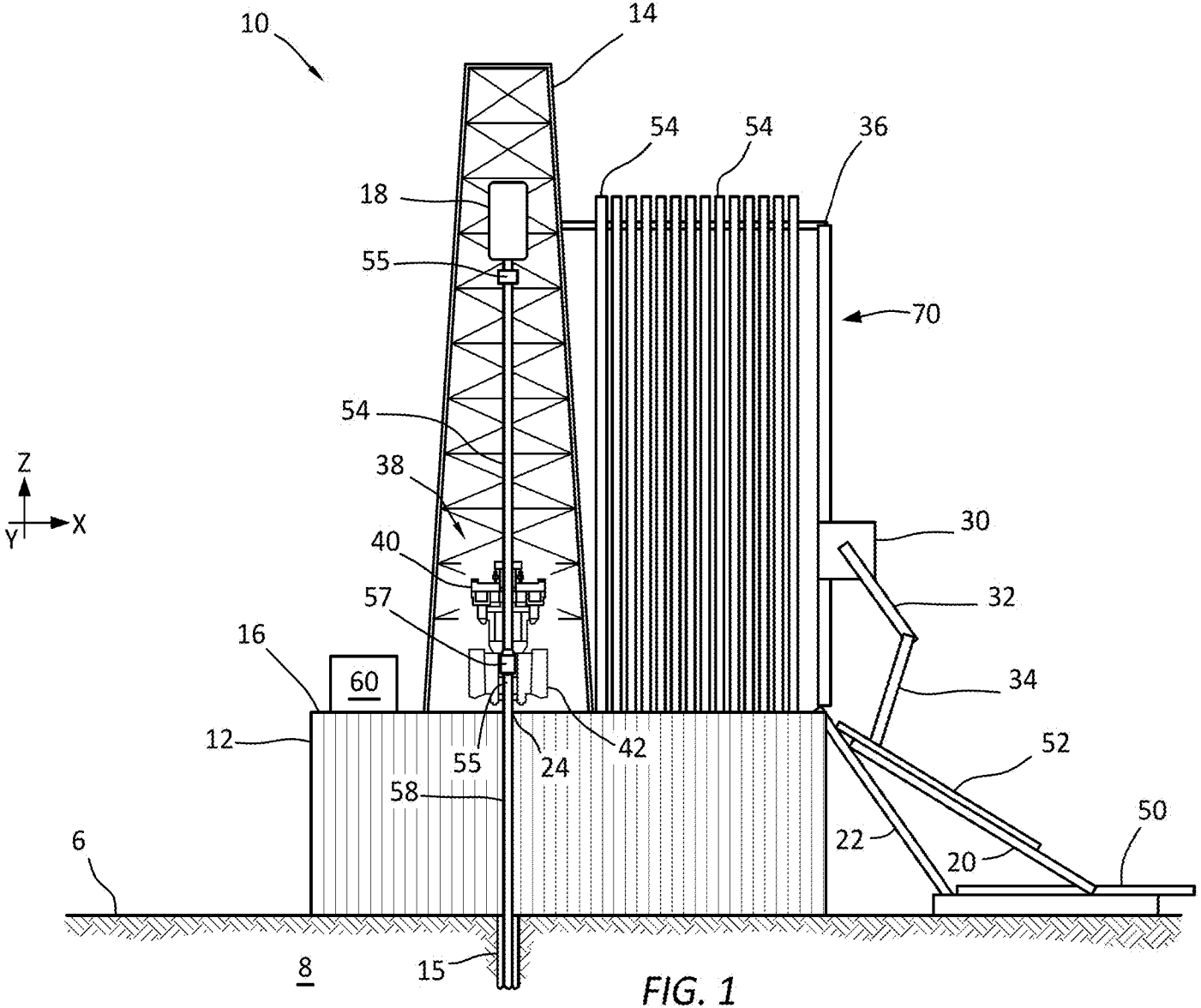
FIG. 1 is a representative simplified front view of a rig being utilized for a subterranean operation, in accordance with certain embodiments.

FIG. 1 is a representative simplified front view of a rig being utilized for a subterranean operation (e.g., tripping in or out a tubular string 58 to or from a wellbore 15), in accordance with certain embodiments. The rig 10 can include a platform 12 with a rig floor 16 and a derrick 14 extending up from the rig floor 16. The derrick 14 can provide support for hoisting the top drive 18 as needed to manipulate tubulars. A catwalk 20 and V-door ramp 22 can be used to transfer horizontally stored tubular segments 50 to the rig floor 16. A tubular segment 52 can be one of the horizontally stored tubular segments 50 that is being transferred to the rig floor 16 via the catwalk 20. A pipe handler 30 with articulating arms 32, 34 can be used to grab the tubular segment 52 from the catwalk 20 and transfer the tubular segment 52 to the top drive 18, the fingerboard 36, the wellbore 15, etc. However, it is not required that a pipe handler 30 be used on the rig 10. The top drive 18 can transfer tubulars directly between the catwalk 20 and the top drive 18 (e.g., using an elevator coupled to the top drive). As used herein, "tubular" refers to an elongated cylindrical tube and can include any of the tubulars manipulated around the rig 10, such as tubular segments 50, 52, tubular stands, tubulars 54, and tubular string 58, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

The tubular string 58 can extend into the wellbore 15, with the wellbore 15 extending through the surface 6 into the subterranean formation 8. When tripping the tubular string 58 into the wellbore 15, tubulars 54 are sequentially added to the tubular string 58 to extend the length of the tubular string 58 into the earthen formation 8. FIG. 1 shows a land-based rig. However, it should be understood that the principles of this disclosure are equally applicable to offshore rigs where "off-shore" refers to a rig with water between the rig floor and the earth surface 6.

When tripping the tubular string 58 out of the wellbore 15, tubulars 54 are sequentially removed from the tubular string 58 to reduce the length of the tubular string 58 in the wellbore 15. The pipe handler 30 can be used to deliver the tubulars 54 to a well center on the rig floor 16 in a vertical orientation and hand the tubulars 54 off to an iron roughneck 38 or a top drive 18. The pipe handler 30 can also be used to remove the tubulars 54 from the well center in a vertical orientation and receive the tubulars 54 from the iron roughneck 38 or a top drive 18. The iron roughneck 38 can make a threaded connection between a tubular 54 being added and the tubular string 58. A spinner assembly 40 can engage a body of the tubular 54 to spin a pin end 57 of the tubular 54 into a threaded box end 55 of the tubular string 58, thereby threading the tubular 54 into the tubular string 58. The wrench assembly 42 can provide a desired torque to the threaded connection, thereby completing the connection. This process can be reversed when the tubulars 54 are being removed from the tubular string 58.

A rig controller 60 can be used to control the rig 10 operations including controlling various rig equipment, such as the pipe handler 30, the top drive 18 and the iron roughneck 38. The rig controller 60 can control the rig equipment autonomously (e.g., without periodic operator interaction), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation). A portion of the rig controller 60 can also be distributed around the rig 10, such as having a portion of the rig controller 60 in the pipe handler 30 and the iron roughneck 38 or at one or more various locations around the rig 10 or remote from the rig 10.

Figure 2:
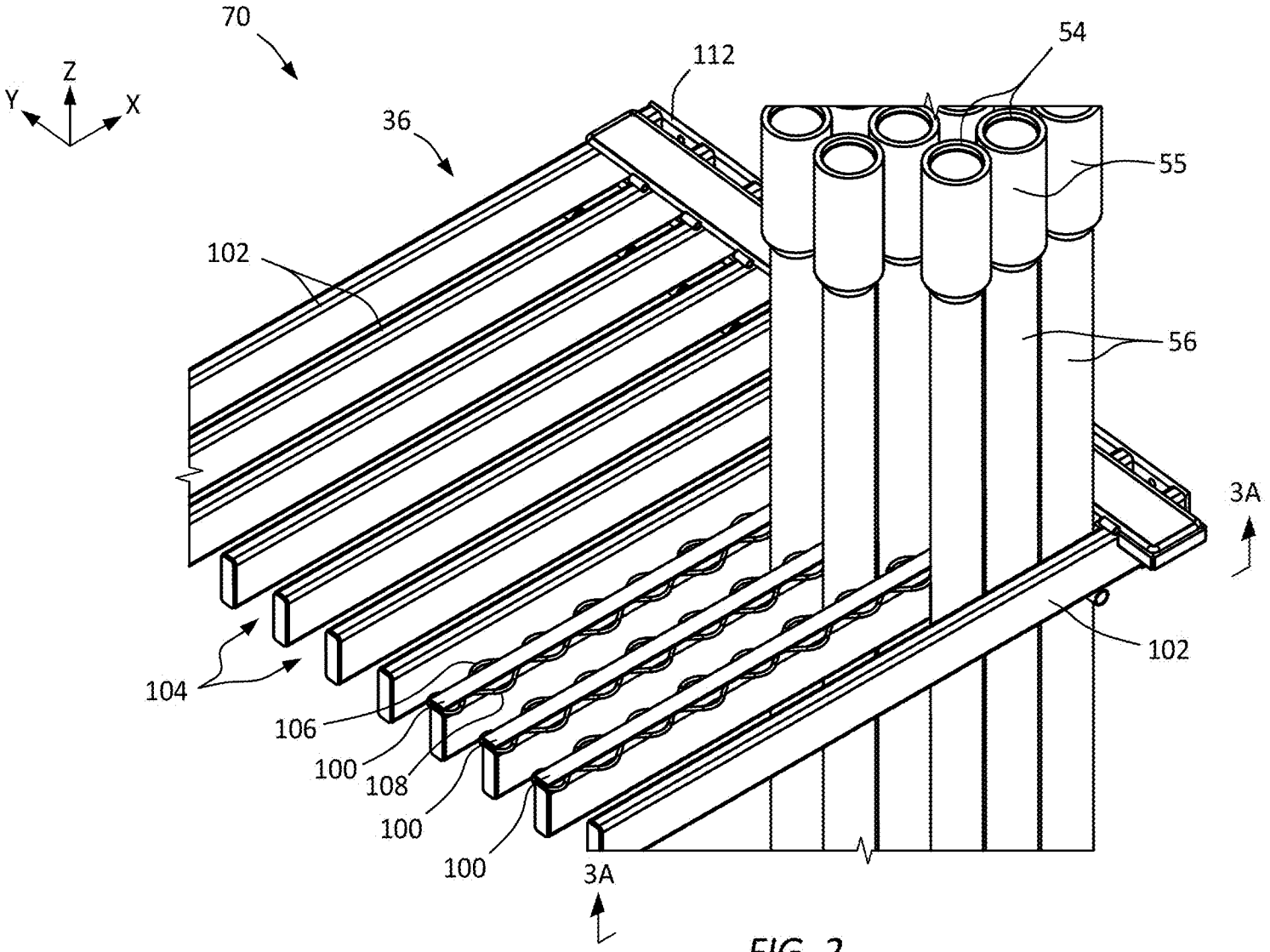
FIG. 2 is a representative perspective view of a fingerboard of a vertical storage area with retention features, in accordance with certain embodiments.

FIG. 2 is a representative perspective view of a fingerboard 36 of a vertical storage area 70 with retention features 100, in accordance with certain embodiments. The fingerboard 36 can include multiple fingers 102 extending horizontally from a support 112. Adjacent fingers 102 can form a channel 104 that is open at one end to allow passage of tubulars into and out of the channel 104.

Vertically oriented tubulars 54 can be positioned within each of the channels 104 formed by the fingers 102. The pin end 57 of a vertically oriented tubular 54 (or substantially oriented vertically tubular 54) can be positioned vertically below the fingerboard 36 in a setback area on the rig floor 16. The box end 55 of the tubular 54 can be positioned vertically above the fingerboard 36 with the body 56 of the tubular 54 extending through a channel 104 of the fingerboard 36, when the tubular 54 is stored in the fingerboard 36. Sometimes the tubulars 54 can be leaned away from a vertical orientation toward the support 112 to urge the tubulars 54 to remain in the channel during various environmental conditions (e.g., wind, rain, heaving seas for offshore rigs, vibrations, sudden shakings, etc.). Tubulars 54 being unexpectedly released from a channel 104 can cause significant damage to rig equipment as well as rig personnel.

Generally, a derrickman works on the fingerboard and physically moves the tubulars 54 into or out of the channels 104 and secures the tubulars in the channels 104. The retention features 100 of the current disclosure can support automated pipe handling by robotic pipe handlers 30 while retaining the tubulars 54 securely in the fingerboard 36 and requiring minimal maintenance.

As shown, a retention feature 100 can be installed/attached to a top surface of one or more fingers 102, with axially spaced part lobes 106, 108 positioned along both sides of the retention feature 100 and protruding into adjacent channels 104. For example, the spaced apart lobes 106 can extend into a channel 104 on one side of the finger 102 on which the retention feature 100 is attached, and the spaced apart lobes 108 can extend into a channel 104 on an opposite side of the finger 102. When a second retention feature 100 is attached to an adjacent finger 102, then the lobes 108 of the first retention feature 100 can axially align with the lobes 106 of the second retention feature 100, with both extending into the same channel 104 toward each other. As used herein, "adjacent" indicates that there are no other similar items between the two "adjacent" items. For example, a finger 102 being adjacent to another finger 102 means that there are no other fingers 102 positioned between the adjacent fingers 102. For example, adjacent lobes 106, means that there are no other lobes 106 between the adjacent lobes 106. For example, adjacent lobes 108, means that there are no other lobes 108 between the adjacent lobes 108.

It should be understood that it is not a requirement that the retention feature 100 be attached to the top of the finger 102. The retention feature can also be attached to a bottom surface of the finger 102 or to a side of the finger 102. If it is attached to the side of the finger 102, then the retention feature 100 can include only the lobes 106 or only lobes 108 that extend into the channel 104. It should also be understood that the lobes along one side of the channel 104, such as lobes 106 or 108, can be different sizes, shapes, biasing strengths, etc. For example, the lobes 106 toward the front of the channel 104 can be shorter than the lobes toward the back of the channel 104. This can be used to accommodate different sized tubulars 54.

This reduced clearance caused by the protruding probes from adjacent retention features 100 produces a resistance to movement of the tubulars 54 along the channel 104 but allows a tubular 54 to move past the protruding lobes 106, 108 when a predetermined force is applied to the tubular 54, such as by a pipe handler 30 or rig operator.

Figure 3A:
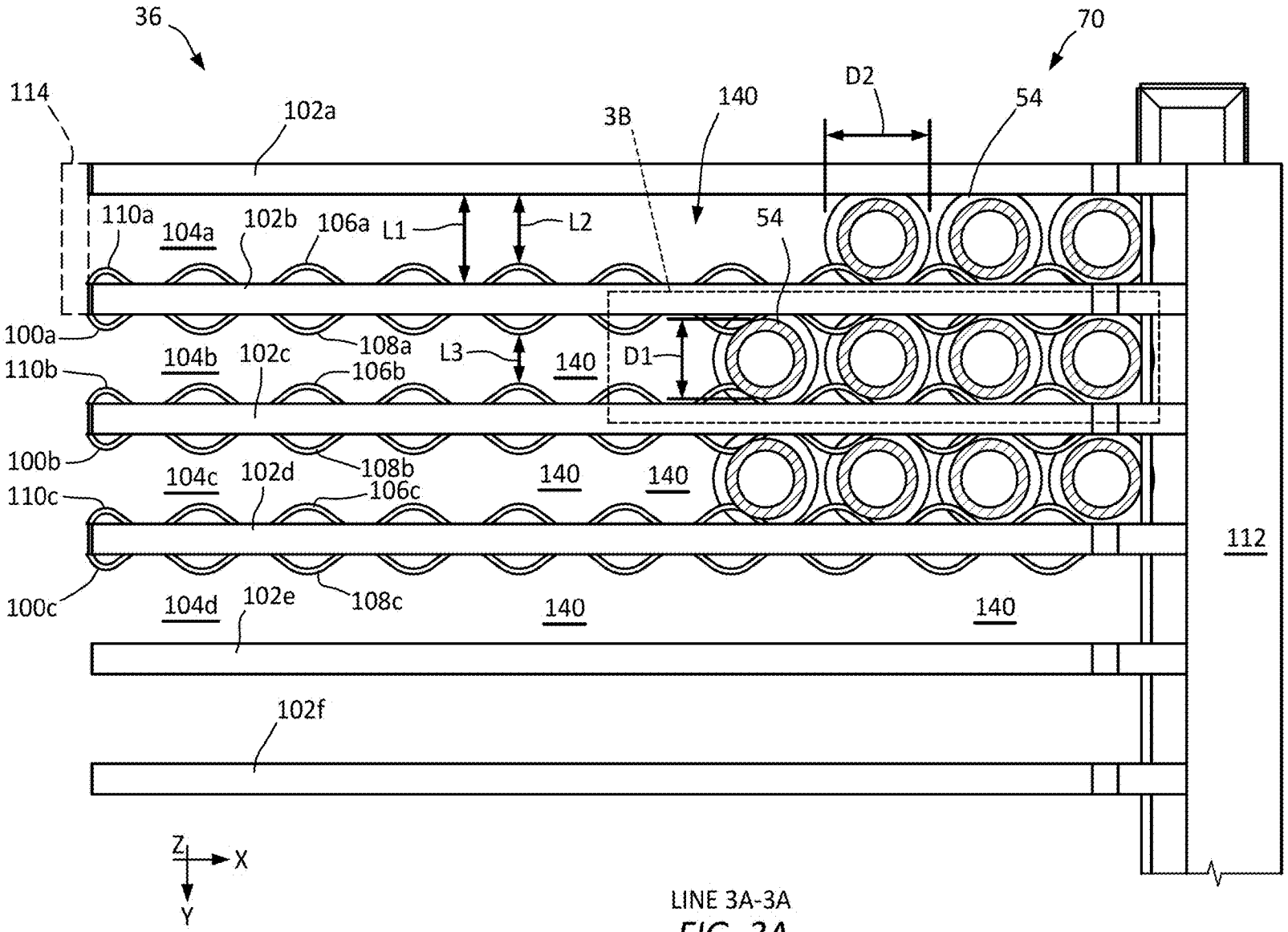
FIG. 3A is a representative partial cross-section view 3A-3A, as indicated in FIG. 2, of a fingerboard of a vertical storage area with retention features, in accordance with certain embodiments.

FIG. 3A is a representative bottom view of a fingerboard 36 of a vertical storage area 70 with retention features 100, in accordance with certain embodiments. A retention feature 100 can be attached to each of the fingers 102*b*, 102*c*, 102*d* (e.g., retention features 100*a*, 100*b*, 100*c*). A retention feature 100 is not shown attached to the fingers 102*a*, 102*c*, 102*f*, but retention features 100 can be attached to these fingers in certain embodiments. In a single lobe configuration, the lobes 106*a* of the retention feature 100*a* can extend into channel 104*a*. No lobes 108 extend from the finger 102*a* toward the lobes 106*a* since a retention feature 100 is not installed on the finger 102*a*. Another example of a single lobe configuration is also illustrated with respect to channel 104*d*. The lobes 108*c* of the retention feature 100*c* can extend into channel 104*d* from the finger 102*d*. No lobes 106 extend from the finger 102*e* toward the lobes 108*c* since a retention feature 100 is not installed on the finger 102*c*.

The channel 104*a* has a width L1 which is larger than an outer diameter D1 of the tubular body 56 to allow the tubular 54 to be moved along the channel 104*a*. The protruding lobes 106*a* are designed to extend toward the adjacent finger 102*a* to reduce a width of the channel 104*a* at the lobe 106*a* to a width L2 that is smaller than the width L1. This configuration (i.e., with lobes extending from only one finger 102) can be used to restrict movement of a tubular 54 along a channel 104. For the tubular 54 to move past the lobe 106 (or lobe 108), the tubular body 56 must compress the lobe 106*a* (or lobe 108*c*) until the width L2 is equal to the outer diameter D1 of the body 56. Increasing the width L2 increases friction between the body 56 and the lobe (106 or 108) as well as the finger 102*a*. A predetermined amount of force can be required to move the tubular past the lobe 106*a* (or lobe 108*c*). The outer diameter D2 of the box end 55 of the tubular 54 is generally larger than the outer diameter D1 of the body 56.

When the tubular 54 is positioned between two adjacent lobes 106 (or lobe 108) on a finger 102, the tubular 54 is positioned within a storage location 140 of a channel 104. When in a storage location 140, it is preferred (but not required) that the lobes 106, 108 of the retention features 100 are not compressed due to engagement with the tubular 54. Fatigue of the lobes 106, 108 can occur if the lobes 106, 108 are engaged with the tubular 54 for extended periods of time. Each area positioned between adjacent lobes 106, 108 can be seen as a storage location 140 for a tubular 54 along a channel 104.

The spacing between adjacent fingers 102 in the fingerboard 36 (such as width L1) and the spacing of the lobes 106*a* along the retention feature 100*a* can determine the diameter of tubulars 54 that can be stored in the channel 104*a* of the vertical storage area 70.

The lobes 106*b* of the retention feature 100*b* and the lobes 108*a* of the retention feature 100*a* can extend into channel 104*b*. The lobes 108*a* of the retention feature 100*a* can extend from the finger 102*b* into the channel 104*b* toward the lobes 106*b* of the retention feature 100*b* and the lobes 106*b* can extend into the channel 104*b* toward the lobes 108*a*. The channel 104*b* can have a width L1 which is larger than an outer diameter D1 of the tubular body 56 to allow the tubular 54 to be moved along the channel 104*b*. The protruding lobes 106*b*, 108*a* can extend into the channel 104*b* to reduce a width of the channel 104*b* at the lobes 106*b*, 108*a* to a width L3 that is smaller than the width L1. It is preferred, but not required, that the lobes 106*b* are axially aligned with the lobes 108*a* along the channel 104*b*.

This two lobe configuration (i.e., with lobes extending from two adjacent fingers 102) can be the preferred configuration to restrict movement of a tubular 54 along a channel 104. For the tubular 54 to move past the lobes 106*b*, 108*a*, the tubular body 56 must compress the pair of axially aligned lobes 106*b*, 108*a*, thereby increasing the width L3. When the width L3 is equal to the outer diameter D1 of the body 56, the tubular 54 can be moved out of the current storage location 140 to an adjacent storage location 140 or out of the channel 104*b* altogether. Increasing the width L3 increases friction between the body 56 and the lobes 106*b*, 108*a* due to the biasing forces of the lobes 106*b*, 108*a* that can increase when they are compressed. A predetermined amount of force can be required to move the tubular 54 past a pair of the lobes 106*b*, 108*a*.

It should be understood that the lobes 106 that extend into a channel 104 do not necessarily need to be axially aligned with the lobes 108 that extend into the channel 104 from an opposite side from the lobes 106. The lobes 106 can be positioned along the fingers to be axially aligned with the lobes 108 or axially misaligned with the lobes 108.

A two lobe configuration is also illustrated with respect to channel 104*c*. Lobes 106*c* can extend from the retention feature 100*c* into the channel 104*c* toward axially aligned lobes 108*b* that can extend from the retention feature 100*b* into the channel 104*c*.

Each of the retention features 100*a*, 100*b*, 100*c* can include ends 110*a*, 110*b*, 110*c*, respectively, where each of the ends may have different shape characteristics compared to the lobes 106 or 108. Additionally, a latch 114 can be used to selectively close off the open end of the channel 104 to prevent any tubulars 54 from exiting the channel 104 when it's closed.

Figure 3B:
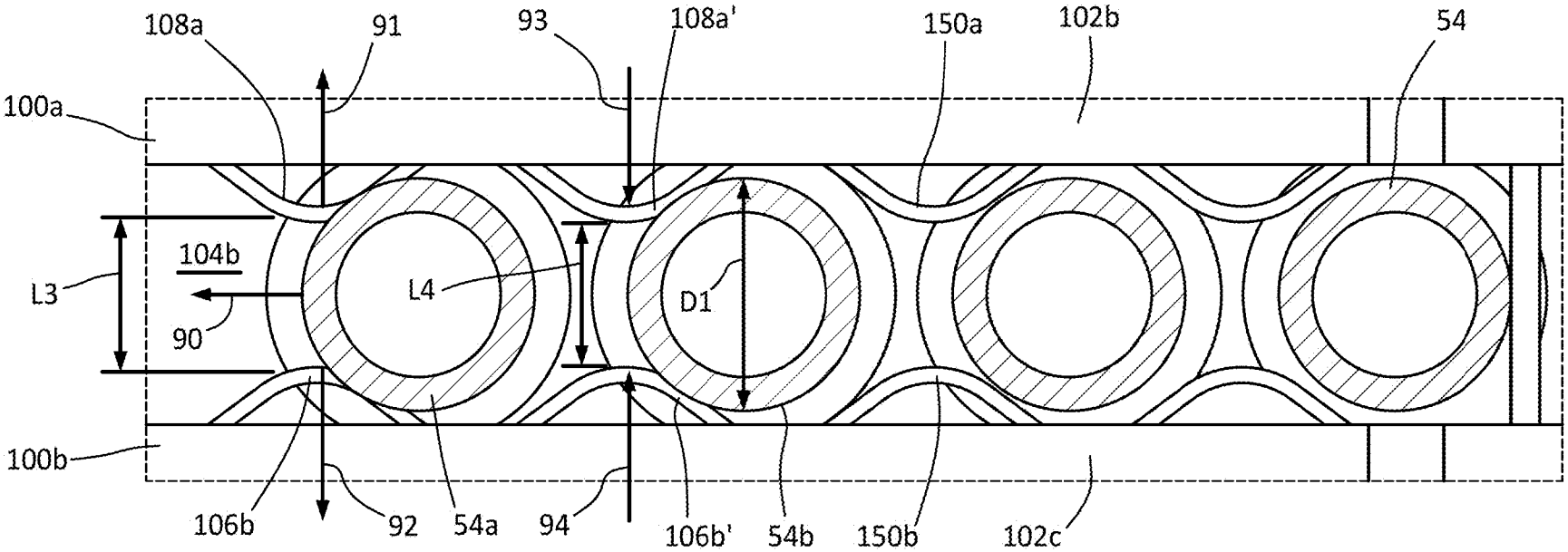
FIG. 3B is a representative detailed view of an area 3B in FIG. 3A, in accordance with certain embodiments.

FIG. 3B is a representative detailed view of an area 3B in FIG. 3A, in accordance with certain embodiments. The lobes 108*a* of the retention feature 100*a* can be formed from a first single biasing element 150*a* (e.g., spring steel, spring steel rod, spring steel flat bar, etc.) and the lobes 106*c* of the retention feature 100*b* can be formed from a second single biasing element 150*b* (e.g., spring steel, spring steel rod, spring steel flat bar, etc.). Therefore, compression of one of the lobes 108*a* will tend to axially move the other lobes 108*a* in the biasing element 150*a*. However, there were unexpected results when the retention features 100 were tested.

The design was developed to provide a biased resistance to movement of tubulars along the channel 104 so a pipe handler can collect from or deposit tubulars into a channel 104 during rig operations. However, the unexpected benefit was detected when it was realized that moving one tubular along the channel 104 and compressing a lobe 106 or 108 causes the other lobes to increase resistance to movement of other tubulars in the channel 104.

For example, in one certain embodiment the predetermined force required to move a single tubular 54 past a pair of axially aligned lobes 106 and 108 in the channel 104 can be approximately 40 pounds. When two tubulars 54 are being moved along the channel 104 (e.g., past two pairs of axially aligned lobes 106 and 108), an elevated force of up to 170 pounds did not successfully move the two tubulars 54 simultaneously past the two pairs of axially aligned lobes 106 and 108. In a certain embodiment, the characteristics of the retention feature 100 can be modified to allow the elevated force required to simultaneously move the second tubular 54 in the channel to be at least 44 pounds (or at least 1.1 times the predetermined force).

Since the lobes 108*a* are loosely held captive in the retention feature 100*a*, the other lobes 108*a* will tend to extend inwardly into the channel 104*b* when one of the lobes 108*a* are compressed into the retention feature 100*a* (i.e., away from the channel 104*b*), such as by forcing a tubular body 56 between a lobe 108*a* and the axially aligned lobe 106*b* of the retention feature 100*b*. The lobes 108*a* on either side of the compressed lobe 108*a* can tend to extend more into the channel 104*b* thereby increasing a retention force for other storage locations 140 along the channel 104. The lobes 106*b* in the retention feature 100*b* will act similarly to the lobes 108*a* described above.

The novel benefit this affords the current retention features 100 is that if two tubulars 54 are trying to move from one storage location 140 to another adjacent storage location, the compression of one pair of axially aligned lobes 108*a*, 106*b* by a tubular 54*a* can cause extension of the other pairs of axially aligned lobes 108*a*, 106*b* which will increase a force needed to move the second tubular 54*b* past the second pair of axially aligned lobes 108*a*, 106*b*.

When the tubular 54*a* is being moved (arrows 90) along the channel 104*b*, the body of the tubular 54*a* will cause the lobe 108*a* to compress inward (arrows 91) toward the retention feature 100*a* and cause the lobe 106*b* to compress inward (arrows 92) toward the retention feature 100*b*. The compression of the lobe 108*a* (arrows 91) can cause the lobe 108*a'* to be extended (arrows 93) into the channel 104*b* and compression of the lobe 106*b* (arrows 92) can cause the lobe 106*b'* to be extended (arrows 94) into the channel 104*b*. Increasing the width L3 by compressing the lobes 108*a*, 106*b* will tend to decrease the width L4 between the lobes 108*a*', 106*b*'.

Therefore, with the biasing elements that form the lobes 108*a*, 106*b*, applying (via the biasing elements) a biasing force that tends to decrease the width L4 will increase the amount of force needed to move the tubular 54*b* from a storage location 140 to an adjacent storage location 140 (e.g., move past the lobes 108*a*', 106*b*'). This increased force requirement helps ensure that only one tubular 54 is moved from a storage location 140 to an adjacent storage location 140, since simultaneously moving two tubulars 54 significantly increases the amount of force needed to move the tubulars 54 along channel 104*b*. The decreased width L4 can cause the amount of force needed to move the second tubular 54 along channel 104*b* to be at least 1.1 times greater, or at least 1.2 times greater, or at least 1.3 times greater, or at least 1.4 times greater, or at least 1.5 times greater, or at least 1.6 times greater, or at least 1.7 times greater, or at least 1.8 times greater, or at least 1.9 times greater, or at least 2 times greater, or at least 2.5 times greater, or at least 3 times greater, or at least 3.5 times greater, or at least 4 times greater, or at least 4.5 times greater, or at least 5 times greater, or at least 5.5 times greater, or at least 6 times greater than the predetermined force used to move the first tubular and less than 20 times, or less than 15 times, or less than 10 times greater than the predetermined force used to move the first tubular.

The retention features 100 described below in reference to FIGS. 4-10 operate similarly with the retention features 100 described in reference to FIGS. 2-3B above.

Figure 4:
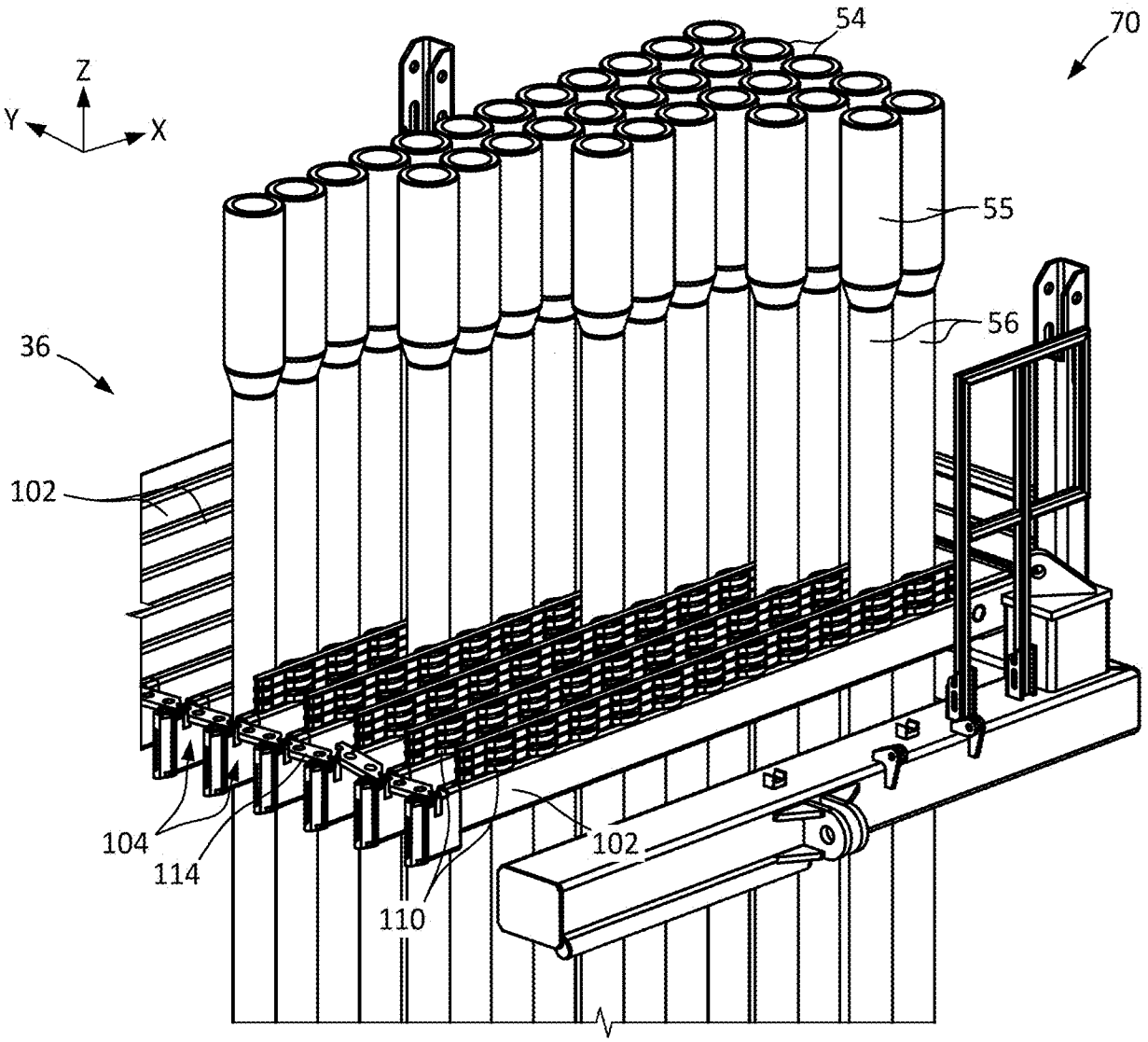
FIG. 4 is a representative perspective view of a fingerboard of a vertical storage area with retention features, in accordance with certain embodiments.

FIG. 4 is a representative perspective view of a fingerboard 36 of a vertical storage area 70 with retention features 100, in accordance with certain embodiments. A retention feature 100 can be attached to a top of one or more fingers 102 of the fingerboard 36. The retention feature 100 can have lobes 106, 108 that include one or more lobes at each lobe position. FIG. 4 shows lobes 106, 108 with three separate lobes at each lobe position along the retention feature 100, but there can be more or less separate lobes at each lobe position. Latches 114 can also be installed at the end of each finger 102 to selectively close off the open end of the respective channel 104.

Figure 5:
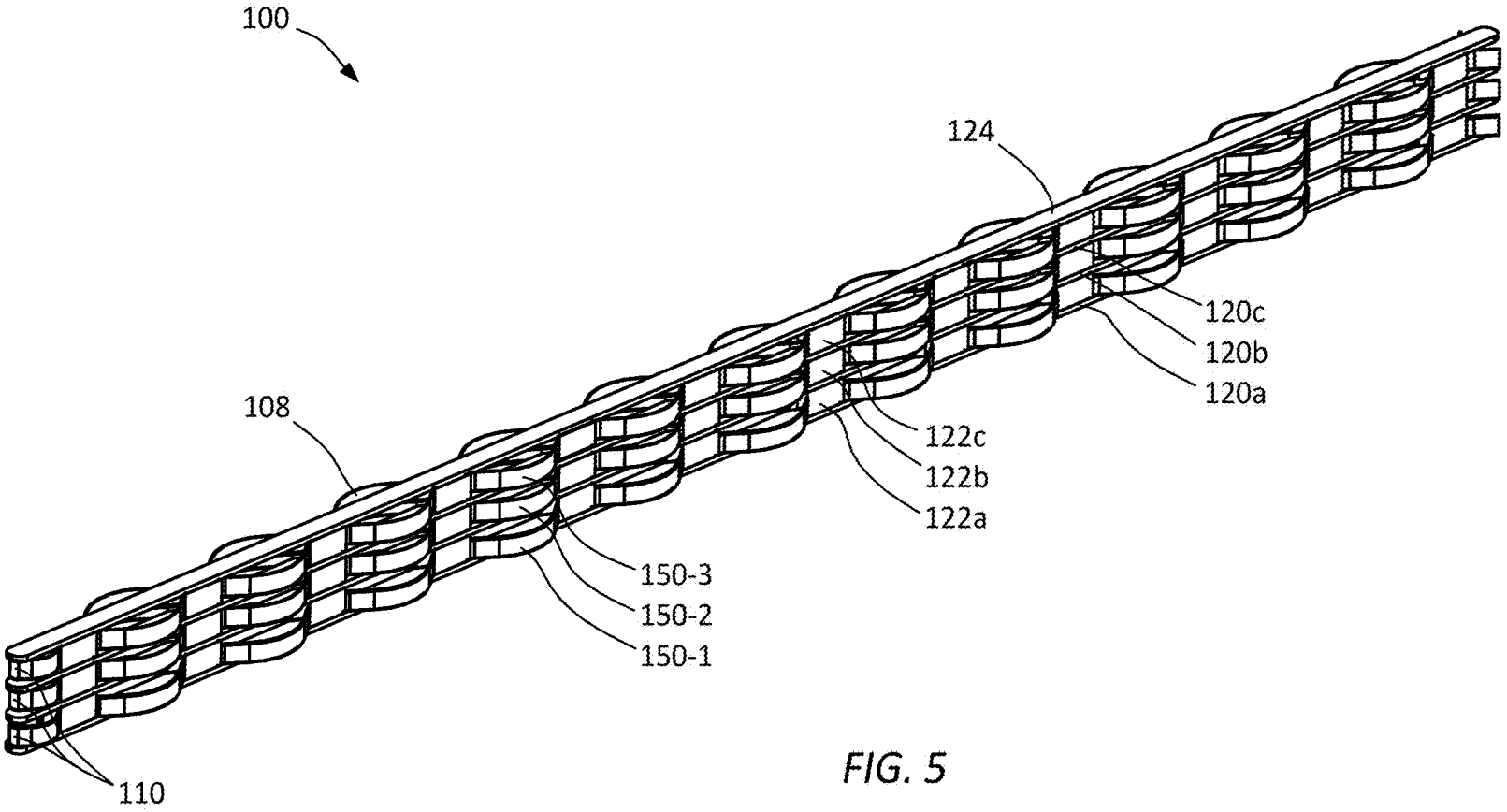
FIG. 5 is a representative perspective view of a retention feature for a fingerboard, in accordance with certain embodiments.

FIG. 5 is a representative perspective view of a retention feature 100 for a fingerboard 36, in accordance with certain embodiments. As shown in FIG. 4, this retention feature 100 can be installed/attached to a top of one or more fingers 102. It is preferred that retention features 100 on adjacent fingers 102 are axially aligned along the channel 104, such that the lobes 108 of one retention feature 100 extends into a channel 104 toward the lobes 106 of an adjacent retention feature 100, where the lobes 106 extend into the channel 104 toward the lobes 108.

In a non-limiting embodiment, the retention feature 100 is configured with three biasing elements 150-1, 150-2, 150-3, which can each form lobes 106 along one side of the retention feature 100 and lobes 108 along an opposite side of the retention feature 100. The end 110 of each biasing elements 150-1, 150-2, 150-3 can transition between the lobes 106 and the lobes 108. However, the biasing elements 150-1, 150-2, 150-3 can include a first biasing element that forms the lobes 106 and a second biasing element that forms the lobes 108. In this configuration, the ends 110 of the first and second biasing elements can merely be the termination of the first and second biasing elements and would not transition between the lobes 106 and lobes 108.

Each of the biasing elements 150-1, 150-2, 150-3 can be formed with a wavy pattern that has hills and valleys. The hills form the lobes 106, 108 and the valleys are used to secure the biasing elements 150-1, 150-2, 150-3 in the retention feature 100 (such as via retainers 122*a*, 122*b*, 122*c*). Each biasing element 150-1, 150-2, 150-3 can include a respective horizontal support 120*a*, 120*b*, 120*c* and a respective retainer 122*a*, 122*b*, 122*c* (e.g., post, pin, formed tower, etc.). The retainers 122*a*, 122*b*, 122*c* are attached to the respective horizontal support 120*a*, 120*b*, 120*c* at a desired spacing along the respective horizontal support 120*a*, 120*b*, 120*c*. The gaps between the retainers 122*a*, 122*b*, 122*c* are where the lobes 106, 108 protrude from the retention feature 100. A top horizontal support 124 is used to attach to the top retainers 122*c* and retain the top biasing element 150-3 in the retention feature 100. The retention feature 100 can be attached to a top (or a bottom) of a finger 102 via fasteners, posts, clips, clamps, welding, etc.

In a non-limiting embodiment, one or more of the biasing elements 150-1, 150-2, 150-3 can be nested beside one another instead of stacked vertically, as shown in FIG. 5. It should also be understood that multiple biasing elements 150 can be stacked vertically and horizontally, as desired, to provide the desired retention of tubulars 54 as well as supporting manufacturability. With biasing elements 150 stacked horizontally, the biasing elements 150 are at the same vertical position with the hills and valleys axially aligned with each other. The horizontally stacked biasing elements 150 operate the same as the other biasing elements where the lobes 106, 108 required a predetermined force to be applied to a tubular 54 to move the tubular 54 from a first storage location to an adjacent second storage location.

Figure 6:
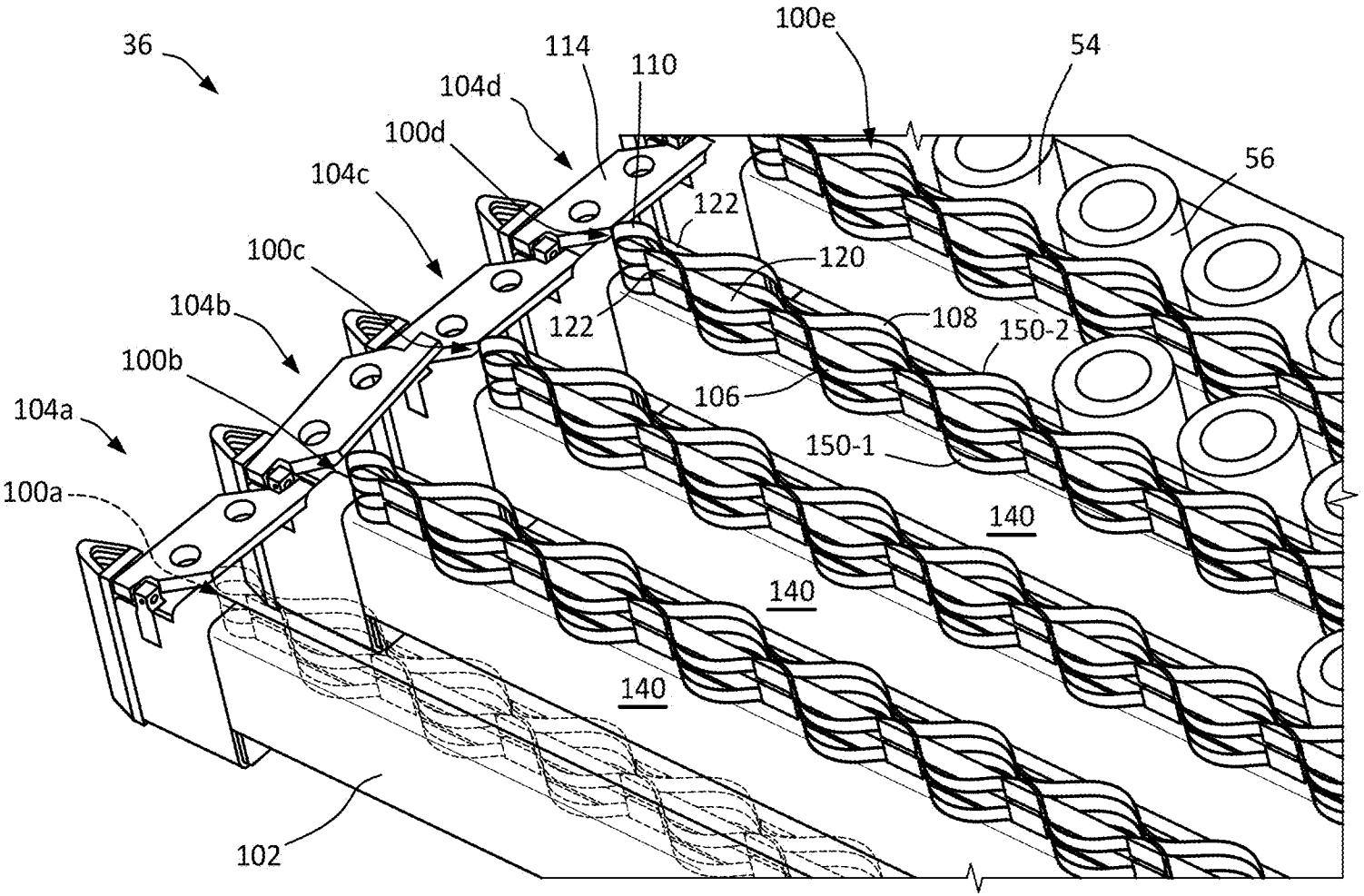
FIG. 6 is a representative perspective partial cross-sectional perspective view of a fingerboard of a vertical storage area with retention features, in accordance with certain embodiments.

FIG. 6 is a representative perspective partial cross-sectional view of a fingerboard 36 of a vertical storage area 70 with retention features 100, in accordance with certain embodiments. Five retention features 100*a*, 100*b*, 100*c*, 100*d*, 100*e* are shown attached to respective fingers 102, with the retention feature 100*a* shown as being optional. Each retention feature 100*a*, 100*b*, 100*c*, 100*d*, 100*e* can be of the configuration shown in FIG. 5, where the top biasing element 150-3 is not shown. However, it also illustrates that the retention feature 100 can include fewer biasing elements than the three shown in FIG. 5.

The tubulars 54 can be moved one at a time into or out of the desired channel 104*a*, 104*b*, 104*c*, 104*d* with the plurality of storage locations 140. Each storage location 140 can contain a tubular 54 where its body 56 extends through the storage location and the lobes 106, 108 on either side of the storage location 140 keeps the tubular 54 in that storage location until a required force is applied to move the tubular 54 out of the storage location 140. The required force causing the respective lobes 106, 108 to compress and allow movement of the tubular from the storage location 140. Latches 114 can be positioned at the open ends of the channels 104*a*, 104*b*, 104*c*, 104*d* to help ensure that a tubular 54 is not inadvertently released from the fingerboard 36. Each latch 114 can be remotely controlled to operate between open and closed positions.

The biasing elements 150-1, 150-2 can be loosely retained in the retention feature 100 by the retainers 122. This allows the biasing elements 150-1, 150-2 to be able to translate along the horizontal support 120 when a lobe is compressed but can minimize movement across the horizontal support 120 (i.e., movement across the support 120 is perpendicular to the movement along the support 120).

Figure 7:
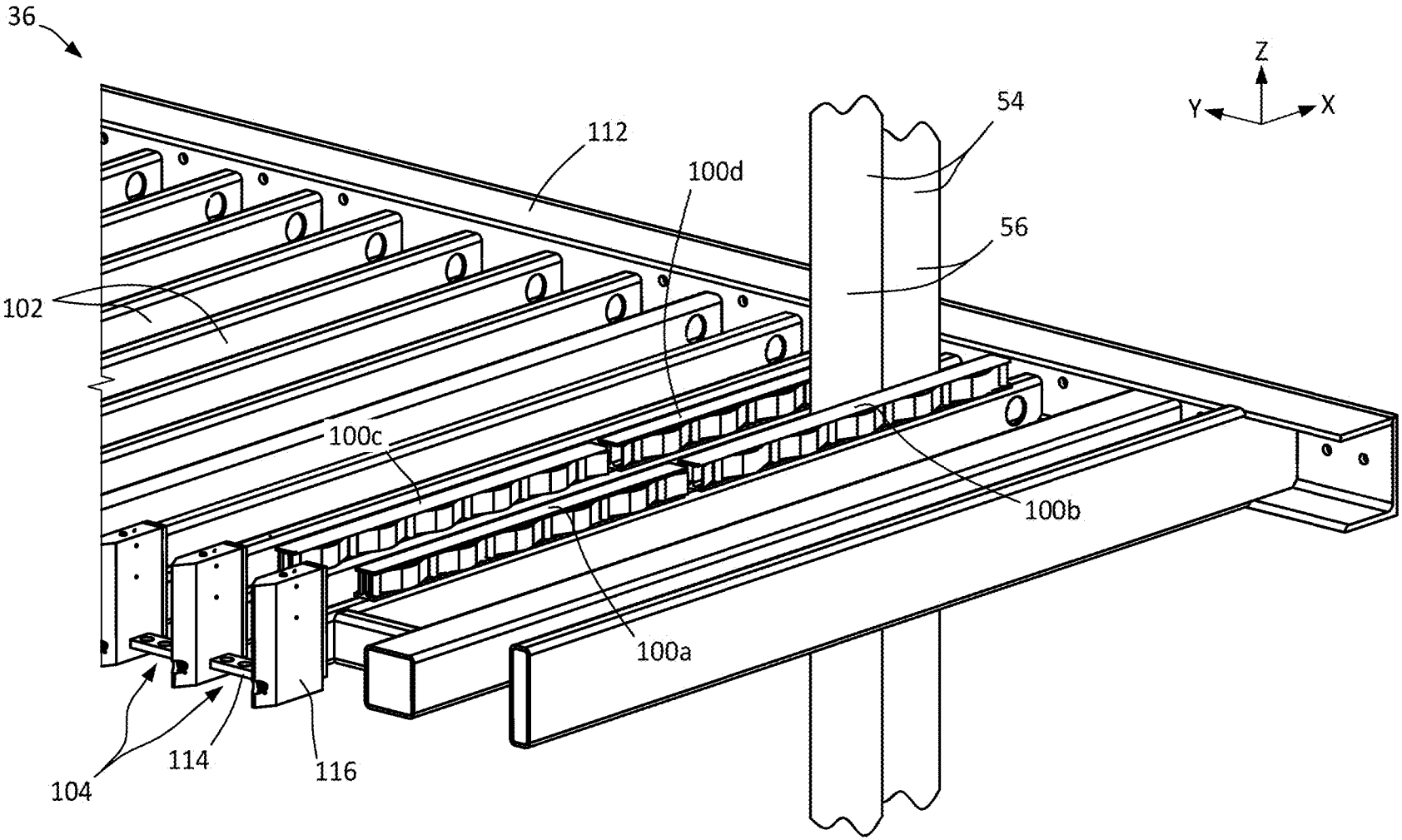
FIG. 7 is a representative perspective view of a fingerboard of a vertical storage area with retention features, in accordance with certain embodiments.

FIG. 7 is a representative perspective view of a fingerboard 36 of a vertical storage area 70 with retention features 100, in accordance with certain embodiments. This configuration illustrates that more than one retention feature 100 can be installed on a single finger 102. All retention features 100 provided in this disclosure can be used in this configuration where two or more are attached to a single finger 102.

In a non-limiting embodiment, retention features 100*a*, 100*b* can be attached to a finger 102 and retention features 100*c*, 100*d* can be attached to an adjacent finger 102. The lobes and valleys of the biasing elements of the retention features 100*a*, 100*b*, 100*c*, 100*d* can define storage locations 140 along the channel 104. Two tubulars 54 are shown located in storage locations 140 at an end of the channel 104. A latch support 116 can be attached on an end of the finger 102 and can be used to actuate the latch 114 between open and closed positions to selectively prevent movement of tubulars 54 into or out of the channel 104.

Figure 8:
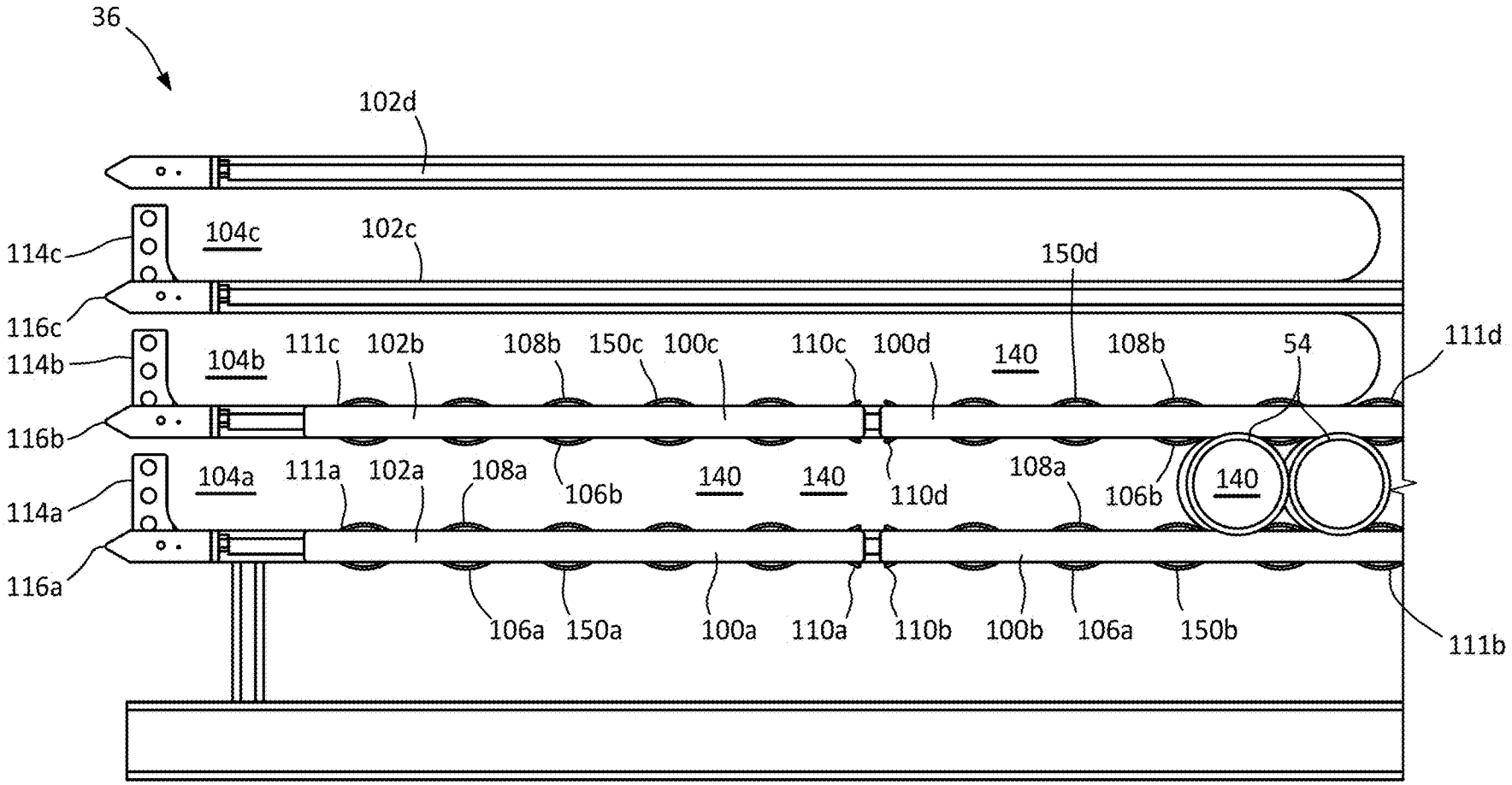
FIG. 8 is a representative top view of a portion of a fingerboard of a vertical storage area with retention features, in accordance with certain embodiments.

FIG. 8 is a representative top view of a portion of a fingerboard 36 of a vertical storage area 70 with retention features 100, in accordance with certain embodiments. The latch supports 116*a*, 116*b*, 116*c* have actuated the respective latches 114*a*, 114*b*, 114*c* to a closed position, thereby preventing movement of a tubular 54 into or out of the channels 104*a*, 104*b*, 104*c*.

The retention feature 100*a* can be mounted along the finger 102*a* in an opposite orientation of and adjacent to the retention feature 100*b*. The ends 110*a*, 110*b* can be positioned adjacent to each other to form protrusions that help define (along with lobes 106 or lobes 108) storage locations 140. The ends 111*a*, 111*b* are positioned at opposite ends of the respective retention features 100*a*, 100*b* and can be terminated ends of biasing elements 150*a*, 150*b* or a transition between lobes 106 and lobes 108 of the respective biasing elements 150*a*, 150*b*.

The retention feature 100*c* can be mounted along the finger 102*b* in an opposite orientation of and adjacent to the retention feature 100*d*. The ends 110*c*, 110*d* can be positioned adjacent to each other to form protrusions that help define (along with lobes 106 or lobes 108) storage locations 140. The ends 111*c*, 111*d* are positioned at opposite ends of the respective retention features 100*c*, 100*d* and can be terminated ends of biasing elements 150*c*, 150*d* or a transition between lobes 106 and lobes 108 of the respective biasing elements 150*c*, 150*d*.

The biasing element 150*a* can be a single biasing element and can form the lobes 106*a*, 108*a* or it can include first and second biasing elements with the first biasing element forming the lobes 106*a* and the second biasing element forming the lobes 108*a*.

Similarly, the biasing elements 150*b*, 150*c*, 150*d* can each be a single biasing element and can form the respective lobes 106, 108 or each one can include first and second biasing elements with the first biasing element forming the respective lobes 106 (e.g., 106*b*, 106*c*, 106*d*) and the second biasing element forming the respective lobes 108 (e.g., 108*b*, 108*c*, 108*d*).

The retention features 100*a*, 100*b*, 100*c*, 100*d* can be attached to a top (or a bottom) of a finger 102 via fasteners, posts, clips, clamps, welding, etc.

Figure 9:
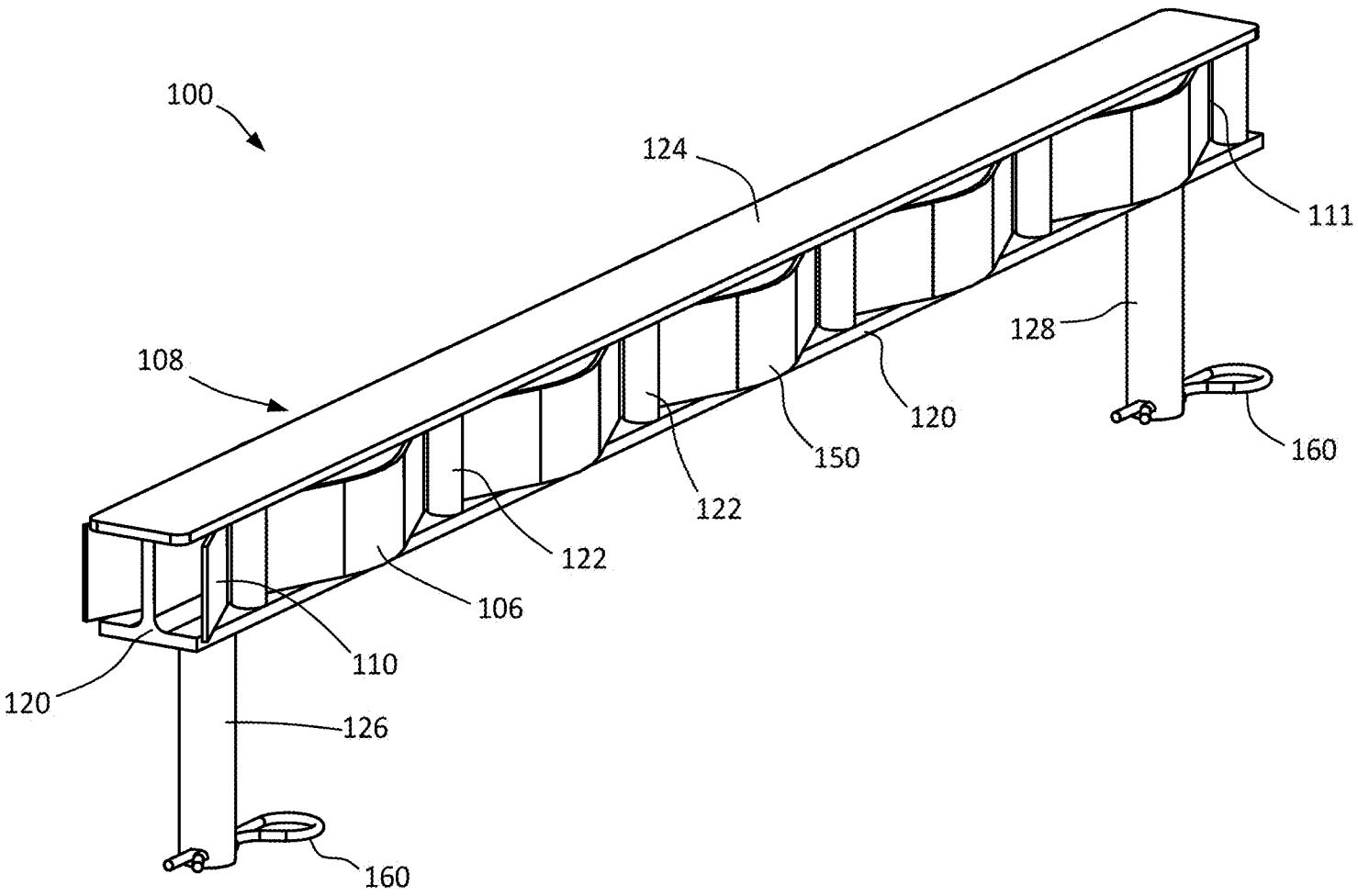
FIG. 9 is a representative perspective view of a retention feature for a fingerboard, in accordance with certain embodiments.

FIG. 9 is a representative perspective view of a retention feature 100 for a fingerboard 36, in accordance with certain embodiments. As shown in FIG. 8, two of these retention features 100 can be attached to a finger 102 in opposite directions, such that the ends 110 are positioned adjacent to each other. The biasing element 150 can be a single biasing element with the lobes 106 and lobes 108 formed therein, with an end 111 that transitions between the lobes 106 on one side of the retention feature 100 to the lobes 108 on the other side of the retention feature 100. The terminal ends 110 of the biasing element 150 can form a partial lobe 106 or 108, and when the ends 110 of one retention feature 100 is positioned adjacent an end 110 of another retention feature 100, the ends 110 of the adjacent retention features 100 can cooperate to define storage locations 140 in the channel 104.

The wavy form of the biasing element 150 can include lobes 106, 108 with valleys between each set of adjacent lobes 106, 108. The valleys can be positioned behind retainers 122 within the retention feature 100, with the lobes 106, 108 extending from the retention feature 100 past the retainers 122. The retainers 122 can be attached between the bottom horizontal support 120 and the top horizontal support 124 at the desired spacing along the horizontal supports 120, 124.

In a non-limiting embodiment, the retention feature 100 can be attached to the finger 102 by support posts 126, 128 which can extend through openings in the finger 102 and can be held in the openings via a retainer 160 (e.g., spring clip, e-ring, captive hardware, threaded fastener, etc.) that can be removably coupled to an end of the support posts 126, 128. Therefore, the retention feature 100 can be removed from the finger 102 by decoupling the retainer 160 from the posts 126, 128 and pulling the posts 126, 128 from the openings in the finger 102.

Figure 10:
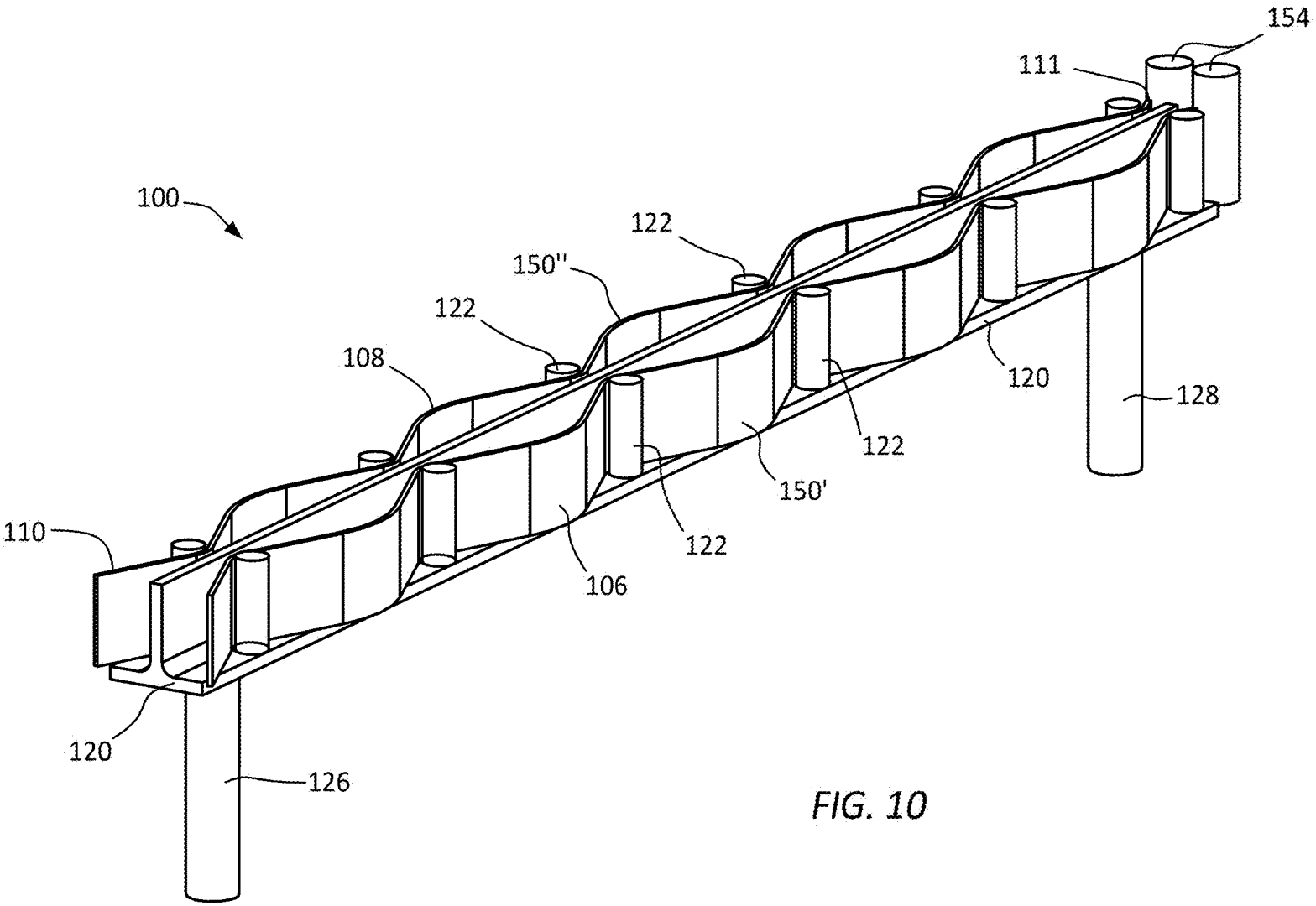
FIG. 10 is a representative partial cross-sectional perspective view of a retention feature for a fingerboard, in accordance with certain embodiments.

FIG. 10 is a representative partial cross-sectional view of a retention feature 100 of FIG. 9 for a fingerboard 36, in accordance with certain embodiments. The top horizontal support 124 has been hidden for discussion purposes. As can be seen, the biasing element 150 can include a first biasing element 150' that forms the lobes 106 and a second biasing element 150" that forms the lobes 108. The bottom horizontal support 120 can have an upside down "T" cross-sectional shape with the leg of the "T" extending upward to separate the first biasing element 150' from the second biasing element 150" along the retention feature 100. A row of equally spaced apart retainers 122 can be positioned along each edge of the bottom horizontal support 120 to provide retention of the first and second biasing elements 150', 150".

A tension controller 154 can be attached to an end 111 (or end 110) to control an amount of tension or compression applied to the biasing element 150', 150" that can act to adjust the biasing force applied to the tubulars 54 by the lobes 106, 108. This can be used to mechanically adjust the fingerboard 36 to handle different diameter tubulars 54 or adjust the pre-determined force required to move a tubular from one storage location 140 to another.

Figure 11:
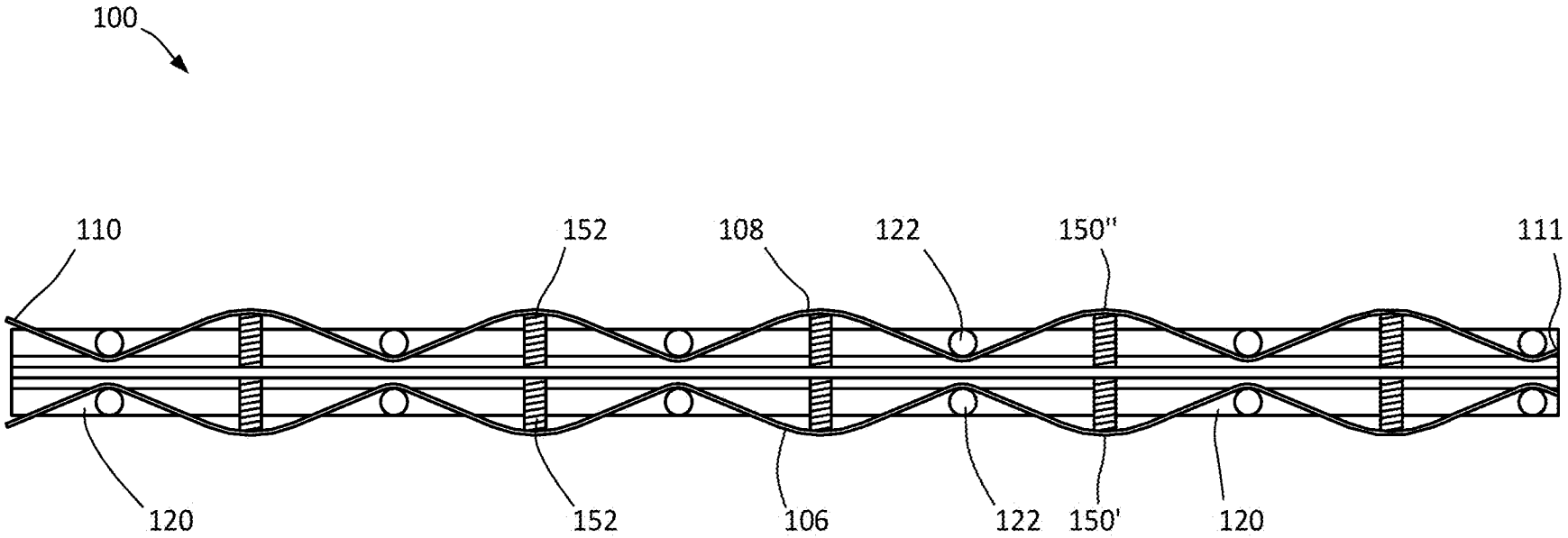
FIG. 11 is a representative partial cross-sectional top view of a retention feature for a fingerboard with supplemental biasing devices, in accordance with certain embodiments.

FIG. 11 is a representative partial cross-sectional top view of a retention feature 100, in accordance with certain embodiments. This retention feature 100 is very similar to the one shown in FIG. 10, except that the lobes 106, 108 can have a supplemental biasing device 152 positioned behind them to assist in sustaining a biasing force of the lobes 106, 108 that resists movement of a tubular 54 from one storage location to another. The biasing devices 152 can be springs, resilient material (e.g., rubber, elastomers, etc.), spring steel, memory metal, etc. Using biasing devices 152 can allow the biasing elements 150', 150" to be made from thinner or smaller material. The biasing device 152 can be positioned between the lobes 106, 108 and the leg of the T-shaped horizontal support, or the biasing device 152 can extend between the lobes 106, 108 in those configurations where the leg of the T-shaped horizontal support is not present.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "generally", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

It should be noted that the X-Y-Z coordinate axes are indicated in various figures, where the X-Y-Z coordinate axes are relative to the rig floor 16. The rig floor 16 forms an X-Y plane with the Z axis being substantially perpendicular with the rig floor 16. As used herein, "horizontal," "horizontal position," or "horizontal orientation" refers to a position that is substantially parallel with the X-Y plane. As used herein, "vertical," "vertical position," or "vertical orientation" refers to a position that is substantially perpendicular relative to the X-Y plane or substantially parallel with the Z axis.

VARIOUS EMBODIMENTS

Embodiment 1

A fingerboard for managing tubulars in a subterranean operation, the fingerboard comprising:

a plurality of fingers comprise a first finger adjacent a second finger with a space therebetween that forms a channel; and a first retention feature attached to the first finger, wherein the first retention feature comprises a first biasing element that comprises a first plurality of lobes, wherein the first plurality of lobes extend into the channel, wherein axially adjacent lobes of the first plurality of lobes define a first storage location therebetween, and wherein movement of a first tubular along the channel from the first storage location to an adjacent second storage location compresses a first lobe of the first plurality of lobes as the first tubular moves past the first lobe.

Embodiment 2

The fingerboard of embodiment 1, wherein a first width of the channel is larger than an outer diameter of a body portion of the first tubular, and wherein a horizontal distance between the first lobe and the second finger is smaller than the outer diameter of the body portion when the first lobe is in an uncompressed state.

Embodiment 3

The fingerboard of embodiment 2, wherein application of a predetermined force moves the first tubular from the first storage location to the adjacent second storage location and compresses the first lobe such that the horizontal distance between the first lobe and the second finger increases to equal the outer diameter of the body portion as the first tubular passes by the first lobe.

Embodiment 4

The fingerboard of embodiment 3, wherein compression of the first lobe extends a second lobe of the first plurality of lobes farther into the channel than in an uncompressed position of the second lobe.

Embodiment 5

The fingerboard of embodiment 4, wherein extension of the second lobe increases a force required to move a second tubular past the second lobe, and wherein the increased force is at least 1.1 times larger than the predetermined force.

Embodiment 6

The fingerboard of embodiment 5, wherein the increased force further resists movement of the second tubular from an adjacent third storage location into the first storage location while the first tubular moves from the first storage location to the adjacent second storage location.

Embodiment 7

The fingerboard of embodiment 1, further comprising a second retention feature attached to the first finger, wherein the second retention feature comprises a second biasing element that comprises a second plurality of lobes, wherein the second plurality of lobes extend into the channel, wherein axially adjacent lobes of the second plurality of lobes define a third storage location therebetween, and wherein movement of the first tubular along the channel from a third storage location to an adjacent fourth storage location compresses a second lobe of the second plurality of lobes as the first tubular moves past the second lobe.

Embodiment 8

The fingerboard of embodiment 1, wherein the first biasing element comprises two or more biasing elements, and wherein the first plurality of lobes comprises two or more pluralities of lobes.

Embodiment 9

The fingerboard of embodiment 8, wherein movement of the first tubular along the channel from the first storage location to the adjacent second storage location compresses multiple first lobes of the two or more pluralities of lobes as the first tubular passes by the multiple first lobes, and wherein the multiple first lobes are axially aligned along the channel.

Embodiment 10

The fingerboard of embodiment 1, further comprising a first plurality of retainers that retains the first biasing element within the first retention feature, wherein each one of the first plurality of lobes extends into the channel between adjacent ones of first plurality of retainers.

Embodiment 11

The fingerboard of embodiment 1, further comprising:

a second retention feature attached to the second finger, wherein the second retention feature comprises a second biasing element that comprises a second plurality of lobes, wherein the second plurality of lobes extend into the channel toward the first plurality of lobes.

Embodiment 12

The fingerboard of embodiment 11, wherein the second plurality of lobes are axially aligned with the first plurality of lobes along the channel.

Embodiment 13

The fingerboard of embodiment 11, wherein axially adjacent lobes of the first plurality of lobes on the first finger and axially adjacent lobes of the second plurality of lobes on the second finger define a storage location therebetween, wherein the axially adjacent lobes of the first plurality of lobes and the axially adjacent lobes of the second plurality of lobes are axially aligned along the channel, and wherein movement of the first tubular along the channel from the first storage location to the adjacent second storage location requires compression of the first lobe of the first plurality of lobes and compression of a second lobe of the second plurality of lobes as the first tubular moves along the channel past the first lobe and the second lobe, and wherein the first lobe is axially aligned with the second lobe.

Embodiment 14

The fingerboard of embodiment 13, wherein compression of the first lobe extends a third lobe of the first plurality of lobes farther into the channel than in an uncompressed position of the third lobe, and wherein the third lobe is adjacent the first lobe on the first finger.

Embodiment 15

The fingerboard of embodiment 14, wherein application of a predetermined force to the first tubular moves the first tubular from the first storage location to the adjacent second storage location.

Embodiment 16

The fingerboard of embodiment 15, wherein compression of the second lobe extends a fourth lobe of the second plurality of lobes farther into the channel than in an uncompressed position of the fourth lobe, and wherein the fourth lobe is adjacent the second lobe on the second finger.

Embodiment 17

The fingerboard of embodiment 16, wherein extension of the third lobe and extension of the fourth lobe increases a force required to move a second tubular past the third lobe and the fourth lobe, and wherein the increased force is at least 1.1 times larger than the predetermined force.

Embodiment 18

The fingerboard of embodiment 17, wherein the increased force further resists movement of the second tubular from an adjacent third storage location into the first storage location while the first tubular moves from the first storage location to the adjacent second storage location.

Embodiment 19

The fingerboard of embodiment 11, wherein the first lobe is axially aligned with a second lobe of the second plurality of lobes.

Embodiment 20

The fingerboard of embodiment 19, wherein a first width of the channel is larger than an outer diameter of a body portion of the first tubular, and wherein a horizontal distance between the first lobe and the second lobe is smaller than the outer diameter of the body portion when the first lobe and the second lobe are in uncompressed states.

Embodiment 21

The fingerboard of embodiment 20, wherein application of a predetermined force moves the first tubular from the first storage location to the adjacent second storage location and compresses the first lobe and the second lobe such that the horizontal distance between the first lobe and the second lobe increases to equal the outer diameter of the body portion.

Embodiment 22

A method for managing tubulars in a fingerboard, the method comprising:

attaching a first retention feature to a first finger of a plurality of fingers of a fingerboard;

extending a first plurality of lobes of a first biasing element from the first retention feature into a channel formed between the first finger and a second finger of the plurality of fingers, wherein the first finger is adjacent to the second finger;

positioning a first tubular in a first storage location formed between a first lobe and an adjacent second lobe of the first plurality of lobes;

positioning a second tubular in a second storage location formed between the second lobe and an adjacent third lobe of the first plurality of lobes;

applying a predetermined force to the first tubular, thereby moving the first tubular out of the first storage location; and compressing the first lobe as the first tubular passes by the first lobe.

Embodiment 23

The method of embodiment 22, wherein compressing the first lobe causes the second lobe to extend further into the channel than in an uncompressed state, thereby increasing a restriction to movement of the second tubular from the second storage location.

Embodiment 24

The method of embodiment 23, wherein increasing the restriction increases a force required to move the second tubular from the second storage location.

Embodiment 25

The method of embodiment 24, wherein the increased force is at least 1.1 times greater than the predetermined force.

Embodiment 26

The method of embodiment 22, further comprising:

attaching a second retention feature to the second finger;

extending a second plurality of lobes of a second biasing element from the second retention feature into the channel, wherein the first plurality of lobes are axially aligned along the channel with the second plurality of lobes;

positioning the first tubular in the first storage location that is formed between a fourth lobe and an adjacent fifth lobe of the second plurality of lobes;

positioning the second tubular in the second storage location that is formed between the fifth lobe and an adjacent sixth lobe of the second plurality of lobes; and compressing the first lobe and the fourth lobe as the first tubular passes by the first lobe and the fourth lobe.

Embodiment 27

The method of embodiment 26, wherein compressing the first lobe causes the second lobe to extend further into the channel than in an uncompressed state and compressing the fourth lobe causes the fifth lobe to extend further into the channel than in an uncompressed state, thereby increasing a restriction to movement of the second tubular from the second storage location.

Embodiment 28

The method of embodiment 27, wherein increasing the restriction increases a force required to move the second tubular from the second storage location.

Embodiment 29

The method of embodiment 28, wherein the increased force is at least 1.1 times greater than the predetermined force.

Embodiment 30

A fingerboard for managing tubulars in a subterranean operation, the fingerboard comprising:

a plurality of fingers comprise a first finger adjacent a second finger with a space therebetween that forms a channel; and a first retention feature attached to the first finger, wherein the first retention feature comprises a first biasing element that comprises a first plurality of lobes, wherein the first plurality of lobes extend into the channel and define a plurality of storage locations in the channel, wherein the plurality of storage locations comprise a first storage location, a second storage location, and a third storage location;

a first tubular disposed in the first storage location; and a second tubular disposed in the second storage location, wherein movement of the first tubular from the first storage location engages the first biasing element and prevents movement of the second tubular from the second storage location while the first tubular is engaged with the first biasing element.

Embodiment 31

The fingerboard of embodiment 30, wherein the movement of the first tubular from the first storage location requires application of a predetermined force to the first tubular to overcome a first biasing force of the first biasing element that resists movement of the first tubular from the first storage location.

Embodiment 32

The fingerboard of embodiment 31, wherein the movement of the second tubular from the second storage location requires application of a second force to the second tubular, and wherein the second force is at least 1.1 times greater than the predetermined force when the first tubular engages the first biasing element.

Embodiment 33

The fingerboard of embodiment 32, wherein the movement of the second tubular from the second storage location requires application of the predetermined force to the second tubular when the first tubular is disengaged from the first biasing element.

Embodiment 34

A fingerboard for managing tubulars in a subterranean operation, the fingerboard comprising:

a plurality of fingers that comprises a first finger adjacent a second finger with a space therebetween that forms a channel; and a first biasing element that comprises a first plurality of lobes, wherein the first plurality of lobes extend into the channel, wherein a first lobe and a second lobe are axially adjacent lobes of the first plurality of lobes, wherein the first lobe and the second lobe define a first storage location therebetween, and wherein movement of a first tubular along the channel from the first storage location to an adjacent second storage location compresses the first lobe as the first tubular moves past the first lobe.

Embodiment 35

The fingerboard of embodiment 34, wherein a first width of the channel is larger than an outer diameter of a body portion of the first tubular, and wherein a horizontal distance between the first lobe and the second finger is smaller than the outer diameter of the body portion when the first lobe is in an uncompressed state.

Embodiment 36

The fingerboard of embodiment 34, wherein application of a predetermined force moves the first tubular from the first storage location to the adjacent second storage location and compresses the first lobe as the first tubular passes by the first lobe.

Embodiment 37

The fingerboard of embodiment 36, wherein compression of the first lobe extends a second lobe of the first plurality of lobes farther into the channel than when the first lobe is in an uncompressed state.

Embodiment 38

The fingerboard of embodiment 37, wherein extension of the second lobe increases a force required to move a second tubular past the second lobe, and wherein the increased force is at least 1.1 times larger than the predetermined force.

Embodiment 39

The fingerboard of embodiment 38, wherein the increased force resists movement of the second tubular from an adjacent third storage location into the first storage location while the first tubular moves from the first storage location to the adjacent second storage location.

Embodiment 40

The fingerboard of embodiment 34, further comprising a second biasing element that comprises a second plurality of lobes, wherein the second plurality of lobes extend into the channel and axially align, along the channel, with the first plurality of lobes, wherein a third lobe and a fourth lobe are axially adjacent lobes of the second plurality of lobes, wherein the third lobe and the fourth lobe further define the first storage location therebetween, and wherein movement of the first tubular along the channel from the first storage location to the second storage location compresses the third lobe of the second plurality of lobes as the first tubular moves past the first lobe and the third lobe.

Embodiment 41

The fingerboard of embodiment 40, wherein movement of the first tubular along the channel from the first storage location to the second storage location requires compression of the first lobe and the third lobe as the first tubular moves along the channel past the first lobe and the third lobe, and wherein the first lobe is axially aligned with the third lobe.

Embodiment 42

The fingerboard of embodiment 41, wherein compression of the first lobe extends the second lobe of the first plurality of lobes farther into the channel than in an uncompressed state of the second lobe.

Embodiment 43

The fingerboard of embodiment 42, wherein application of a predetermined force to the first tubular moves the first tubular from the first storage location to the second storage location.

Embodiment 44

The fingerboard of embodiment 43, wherein compression of the third lobe extends a fourth lobe of the second plurality of lobes farther into the channel than in an uncompressed state of the fourth lobe.

Embodiment 45

The fingerboard of embodiment 44, wherein extension of the second lobe and extension of the fourth lobe increases a force required to move a second tubular past the second lobe and the fourth lobe, and wherein the increased force is at least 1.1 times larger than the predetermined force.

Embodiment 46

A method for managing tubulars in a fingerboard, the method comprising:

attaching a first retention feature to a first finger of a plurality of fingers of a fingerboard;

extending a first plurality of lobes of a first biasing element from the first retention feature into a channel formed between the first finger and a second finger of the plurality of fingers, wherein the first finger is adjacent to the second finger;

forming a first storage location between a first lobe and an adjacent second lobe of the first plurality of lobes, wherein the first storage location is configured to receive and retain a first tubular;

forming a second storage location between the second lobe and an adjacent third lobe of the first plurality of lobes, wherein the second storage location is configured to receive and retain a second tubular;

applying a predetermined force to the first tubular, thereby moving the first tubular out of the first storage location; and compressing the first lobe as the first tubular passes by the first lobe.

Embodiment 47

The method of embodiment 46, wherein compressing the first lobe causes the second lobe to extend further into the channel than in an uncompressed state, thereby increasing a force required to move the second tubular from the second storage location, and wherein the increased force is at least 1.1 times greater than the predetermined force.

Embodiment 48

The method of embodiment 46, further comprising:

attaching a second retention feature to the second finger;

extending a second plurality of lobes of a second biasing element from the second retention feature into the channel, wherein the first plurality of lobes are axially aligned along the channel with the second plurality of lobes, wherein forming the first storage location further comprises forming the first storage location between a fourth lobe and an adjacent fifth lobe of the second plurality of lobes, and wherein forming the second storage location further comprises forming the second storage location between the fifth lobe and an adjacent sixth lobe of the second plurality of lobes; and compressing the first lobe and the fourth lobe as the first tubular passes by the first lobe and the fourth lobe.

Embodiment 49

The method of embodiment 48, wherein compressing the first lobe causes the second lobe to extend further into the channel than in an uncompressed state and compressing the fourth lobe causes the fifth lobe to extend further into the channel than in an uncompressed state, thereby increasing a force required to move the second tubular from the second storage location, and wherein the increased force is at least 1.1 times greater than the predetermined force and less than 20 times the predetermined force.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A fingerboard for managing tubulars in a subterranean operation, the fingerboard comprising:

a plurality of fingers comprise a first finger adjacent a second finger with a space therebetween that forms a channel; and a first retention feature attached to the first finger, wherein the first retention feature comprises a first biasing element that comprises a first plurality of lobes, wherein the first plurality of lobes extend into the channel and define a plurality of storage locations in the channel, wherein the plurality of storage locations comprise a first storage location, a second storage location, and a third storage location;

a first tubular disposed in the first storage location; and a second tubular disposed in the second storage location, wherein movement of the first tubular from the first storage location engages the first biasing element and prevents movement of the second tubular from the second storage location while the first tubular is engaged with the first biasing element, wherein the movement of the first tubular from the first storage location requires application of a predetermined force to the first tubular to overcome a first biasing force of the first biasing element that resists movement of the first tubular from the first storage location, and wherein the movement of the second tubular from the second storage location requires application of a second force to the second tubular, and wherein the second force is at least 1.1 times greater than the predetermined force when the first tubular engages the first biasing element.

2. The fingerboard of claim 1, wherein the movement of the second tubular from the second storage location requires application of the predetermined force to the second tubular when the first tubular is disengaged from the first biasing element.

3. A fingerboard for managing tubulars in a subterranean operation, the fingerboard comprising:

a plurality of fingers that comprises a first finger adjacent a second finger with a space therebetween that forms a channel; and a first biasing element that comprises a first plurality of lobes, wherein the first plurality of lobes extend into the channel, wherein a first lobe and a second lobe are axially adjacent lobes of the first plurality of lobes, wherein the first lobe and the second lobe define a first storage location therebetween, and wherein movement of a first tubular along the channel from the first storage location to an adjacent second storage location compresses the first lobe as the first tubular moves past the first lobe, wherein application of a predetermined force moves the first tubular from the first storage location to the adjacent second storage location and compresses the first lobe as the first tubular passes by the first lobe, and wherein compression of the first lobe extends a second lobe of the first plurality of lobes farther into the channel than when the first lobe is in an uncompressed state.

4. The fingerboard of claim 3, wherein a first width of the channel is larger than an outer diameter of a body portion of the first tubular, and wherein a horizontal distance between the first lobe and the second finger is smaller than the outer diameter of the body portion when the first lobe is in an uncompressed state.

5. The fingerboard of claim 3, wherein extension of the second lobe increases a force required to move a second tubular past the second lobe, and wherein the increased force is at least 1.1 times larger than the predetermined force.

6. The fingerboard of claim 5, wherein the increased force resists movement of the second tubular from an adjacent third storage location into the first storage location while the first tubular moves from the first storage location to the adjacent second storage location.

7. The fingerboard of claim 3, further comprising a second biasing element that comprises a second plurality of lobes, wherein the second plurality of lobes extend into the channel and axially align, along the channel, with the first plurality of lobes, wherein a third lobe and a fourth lobe are axially adjacent lobes of the second plurality of lobes, wherein the third lobe and the fourth lobe further define the first storage location therebetween, and wherein movement of the first tubular along the channel from the first storage location to the second storage location compresses the third lobe of the second plurality of lobes as the first tubular moves past the first lobe and the third lobe.

8. The fingerboard of claim 7, wherein movement of the first tubular along the channel from the first storage location to the second storage location requires compression of the first lobe and the third lobe as the first tubular moves along the channel past the first lobe and the third lobe, and wherein the first lobe is axially aligned with the third lobe.

9. The fingerboard of claim 8, wherein compression of the first lobe extends the second lobe of the first plurality of lobes farther into the channel than in an uncompressed state of the second lobe.

10. The fingerboard of claim 9, wherein application of a predetermined force to the first tubular moves the first tubular from the first storage location to the second storage location.

11. The fingerboard of claim 10, wherein compression of the third lobe extends a fourth lobe of the second plurality of lobes farther into the channel than in an uncompressed state of the fourth lobe.

12. The fingerboard of claim 11, wherein extension of the second lobe and extension of the fourth lobe increases a force required to move a second tubular past the second lobe and the fourth lobe, and wherein the increased force is at least 1.1 times larger than the predetermined force.

13. A method for managing tubulars in a fingerboard, the method comprising:

attaching a first retention feature to a first finger of a plurality of fingers of a fingerboard;

extending a first plurality of lobes of a first biasing element from the first retention feature into a channel formed between the first finger and a second finger of the plurality of fingers, wherein the first finger is adjacent to the second finger;

forming a first storage location between a first lobe and an adjacent second lobe of the first plurality of lobes, wherein the first storage location is configured to receive and retain a first tubular;

forming a second storage location between the second lobe and an adjacent third lobe of the first plurality of lobes, wherein the second storage location is configured to receive and retain a second tubular;

applying a predetermined force to the first tubular, thereby moving the first tubular out of the first storage location; and compressing the first lobe as the first tubular passes by the first lobe, wherein compressing the first lobe causes the second lobe to extend further into the channel than in an uncompressed state, thereby increasing a force required to move the second tubular from the second storage location, and wherein the increased force is at least 1.1 times greater than the predetermined force.

14. The method of claim 13, further comprising:

attaching a second retention feature to the second finger;

extending a second plurality of lobes of a second biasing element from the second retention feature into the channel, wherein the first plurality of lobes are axially aligned along the channel with the second plurality of lobes, wherein forming the first storage location further comprises forming the first storage location between a fourth lobe and an adjacent fifth lobe of the second plurality of lobes, and wherein forming the second storage location further comprises forming the second storage location between the fifth lobe and an adjacent sixth lobe of the second plurality of lobes; and compressing the first lobe and the fourth lobe as the first tubular passes by the first lobe and the fourth lobe.

15. The method of claim 14, wherein compressing the first lobe causes the second lobe to extend further into the channel than in an uncompressed state and compressing the fourth lobe causes the fifth lobe to extend further into the channel than in an uncompressed state, thereby increasing a force required to move the second tubular from the second storage location, and wherein the increased force is at least 1.1 times greater than the predetermined force and less than 20 times the predetermined force.

* * * * *